US008776481B2

(12) United States Patent
Miyahara et al.

(10) Patent No.: US 8,776,481 B2
(45) Date of Patent: Jul. 15, 2014

(54) PACKING-PACKAGING APPARATUS

(75) Inventors: Fumio Miyahara, Osaka (JP); Yoshiyuki Tsuji, Osaka (JP); Tomohiro Takemoto, Toyama (JP)

(73) Assignees: Ohki Co., Ltd., Osaka-shi (JP); Tsubakimoto Kogyo Co., Ltd., Osaka-shi (JP); Fabrica Toyama Corporation, Osaka-shi (JP)

( * ) Notice: Subject to any disclaimer, the term of this patent is extended or adjusted under 35 U.S.C. 154(b) by 271 days.

(21) Appl. No.: 12/920,746

(22) PCT Filed: Jan. 15, 2009

(86) PCT No.: PCT/JP2009/050489
§ 371 (c)(1),
(2), (4) Date: Sep. 2, 2010

(87) PCT Pub. No.: WO2010/082337
PCT Pub. Date: Jul. 22, 2010

(65) Prior Publication Data
US 2011/0005172 A1 Jan. 13, 2011

(51) Int. Cl.
*B65B 1/06* (2006.01)

(52) U.S. Cl.
USPC ..... 53/55; 43/450; 43/451; 43/551

(58) Field of Classification Search
USPC ..... 53/450, 451–452, 52, 55, 501–504, 53/147, 152, 545, 550, 551, 574, 576
See application file for complete search history.

(56) References Cited

U.S. PATENT DOCUMENTS 3,906,964 A * 9/1975 Ushio et al. ..... 453/63
4,262,473 A 4/1981 Brooke
4,514,959 A * 5/1985 Shroyer ..... 53/428
4,782,644 A * 11/1988 Haarer et al. ..... 53/282

(Continued)

FOREIGN PATENT DOCUMENTS

JP A-02-152610 6/1990
JP A-2001-519729 10/2001

(Continued)

OTHER PUBLICATIONS

International Search Report in International Application No. PCT/JP2009/050489, dated Mar. 3, 2009 (with English translation).

(Continued)

*Primary Examiner* — Christopher Harmon
(74) *Attorney, Agent, or Firm* — Oliff PLC

(57) ABSTRACT

A packing-packaging machine includes: sheet feeding means; a horizontal bonding unit for forming a bag body by forming horizontal bonding on a tubular body at predetermined intervals; and an object dispensing unit for dispensing an object to be packaged to the bag body during a repetition of the formation of the horizontal bonding. The object dispensing unit includes a shutter for opening and closing a falling path of a predetermined amount of the object into the bag body. The shutter is opened and closed such that the predetermined amount of the object and another predetermined amount of the object fall with a spacing therebetween, and that before the horizontal bonding is formed on the bag body packed with the predetermined amount of the object which has been dropped during opening-closing operation of the shutter, the other predetermined amount of the object for a next bag body starts falling.

14 Claims, 16 Drawing Sheets

(56) References Cited

U.S. PATENT DOCUMENTS

| | | | | |
|---|---|---|---|---|
| 4,827,697 | A * | 5/1989 | Ross | 53/437 |
| 4,865,092 | A * | 9/1989 | Reichelt | 141/280 |
| 4,965,986 | A | 10/1990 | Klinkel | |
| 5,082,032 | A * | 1/1992 | Crocker | 141/1 |
| 5,241,804 | A * | 9/1993 | Tsuruta et al. | 53/504 |
| 5,271,206 | A * | 12/1993 | Tetenborg | 53/411 |
| 5,743,069 | A * | 4/1998 | Ansaloni | 53/282 |
| 5,873,216 | A | 2/1999 | Appelbe et al. | |
| 6,367,230 | B1 * | 4/2002 | Fukuda | 53/451 |
| 6,427,422 | B2 * | 8/2002 | Nakagawa et al. | 53/437 |
| 6,460,312 | B1 * | 10/2002 | Nakagawa et al. | 53/55 |
| 6,612,347 | B2 * | 9/2003 | Hill | 141/83 |
| 6,945,008 | B2 * | 9/2005 | Nakagawa et al. | 53/52 |
| 7,117,653 | B2 * | 10/2006 | Yakushigawa et al. | 53/53 |
| 7,204,794 | B2 | 4/2007 | Rea et al. | |
| 7,350,339 | B2 * | 4/2008 | Yakushigawa et al. | 53/551 |
| 7,404,789 | B2 | 7/2008 | Rea et al. | |
| 7,426,815 | B1 * | 9/2008 | Wilson et al. | 53/527 |
| 2002/0121076 | A1 * | 9/2002 | Nakagawa et al. | 53/493 |
| 2005/0115210 | A1 | 6/2005 | Noumi | |
| 2008/0091299 | A1 | 4/2008 | Yoshikawa et al. | |

FOREIGN PATENT DOCUMENTS

| | | |
|---|---|---|
| JP | A-2002-046704 | 2/2002 |
| JP | A-2003-72720 | 3/2003 |
| JP | A-2003-237701 | 8/2003 |
| JP | B2-3661125 | 6/2005 |
| JP | A-2006-510550 | 3/2006 |
| JP | B2-3856597 | 12/2006 |
| JP | A-2007-84100 | 4/2007 |
| JP | A-2008-062988 | 3/2008 |

OTHER PUBLICATIONS

Oct. 8, 2012 Office Action issued in Chinese Patent Application No. 200980154753.5 (with translation).

"Submission of Publications and the like" submitted by a third party in Japanese Patent Application No. 2010-546517 dated Oct. 15, 2013 (w/ translation).

Chinese Office Action issued in Chinese Patent Application No. 200980154753.5 dated Jun. 19, 2013 (w/ translation).

Extended European Search Report issued in European Patent Application No. 09 838 306.0 dated Sep. 4, 2013.

European Office Action issued in European Patent Application No. 09 838 306.0 dated Apr. 14, 2014.

* cited by examiner (A-A cross-section)

(C-C cross-section)

(View taken in direction of arrow E)

(View taken in direction of arrow D)

PACKING-PACKAGING APPARATUS

TECHNICAL FIELD

The present invention relates to a packing-packaging method and machine for forming a packaging sheet into bags and packing the bags with an object to be packaged.

BACKGROUND TECHNOLOGY

Commonly used extraction bags include tea bags for black teas, green teas, herbal teas, and other teas and extraction bags containing dried material such as dried small sardine and dried bonito for preparing stock. Such an extraction bag includes a tetrahedral or rectangular bag body formed from a water-permeable filter extraction bag sheet such as a non-woven fabric sheet, and an extractable material, such as tea leaves, packed in the bag body. If necessary, a hanging string with a tag is attached to the outer surface of the bag body.

Such extraction bags, specifically tetrahedral extraction bags with strings and tags, for example, can be manufactured as follows. An extraction bag sheet prepared by disposing tags and a string used as a hanging string on a strip-like water-permeable filter sheet is shaped into a tubular form by bonding the opposite end portions of the extraction bag sheet to each other. Then the formation of first horizontal bonding by flattening, welding, and cutting the tubular body in a first width direction and the formation of second horizontal bonding by welding and cutting the cut tubular body in a second width direction intersecting the first width direction are performed alternately. An extractable material, such as tea leaves, is packed between the formation of the first bonding and the formation of the second bonding (Patent Documents 1 and 2).

In one exemplary method of packing such bags with an extractable material, an auger screw attached inside a packing pipe for supplying the extractable material from a hopper to a bag body is rotated to supply a predetermined amount of the extractable material to the bag body (Patent Document 3). In another exemplary method, an extractable material stored in a hopper is measured with measures formed in a rotary table and is supplied to a bag body through a chute pipe (Patent Document 4).

[Patent Document 1] Published Japanese Translation of PCT International Application No. 2001-519729

[Patent Document 2] Published Japanese Translation of PCT International Application No. 2006-510550

[Patent Document 3] Japanese Patent Application Laid-Open No. 2003-237701

[Patent Document 4] Japanese Patent Application Laid-Open No. 2002-46704

DISCLOSURE OF THE INVENTION

Problems to be Solved by the Invention

However, with the packing method using an auger screw, when tea leaves are packed, they can be undesirably pulverized.

In the packing method using measures, one measure is disposed above a bonding unit for producing a bag, and the measure and the bonding unit are connected through a chute pipe. The tea leaves measured into the measure are dropped through the chute pipe into a bag body to pack it with the tea leaves, and horizontal bonding is formed to seal the bag body, whereby an extraction bag is obtained. After completion of the formation of the horizontal bonding, the tea leaves are again dropped in a similar manner. The process of dropping the tea leaves and forming the horizontal bonding is repeated to produce extraction bags one after the other. Therefore, in the conventional packing method using measures, it is difficult to improve the production rate because the period of time after the tea leaves are fed into the chute pipe until the falling tea leaves reach a bag body is rate-limiting. For example, unfortunately, only about 50 to 100 tea bags can be produced per minute.

In view of the foregoing, it is an object of the present invention to enable an object such as tea leaves to be packed and packaged in bag bodies formed from a packaging sheet at high speed without pulverization of the object.

Means for Solving the Problems

The present inventor has found the following facts. (i) In a process of dropping an object for a single bag into a bag body through a chute pipe or the like to pack the bag body with the object and forming horizontal bonding to package the object, the rate of packing-packaging can be drastically improved by allowing the object for a plurality of bags to be present in the chute pipe. This state can be created by dropping the object for a first bag and then dropping the object for a second bag before the packaging of the dropped object for the first bag is completed. (ii) The falling-direction front end of the object falling by its own weight does not reach a bag body at a time earlier than the time computed using the gravitational acceleration because of, for example, friction with respect to the chute pipe and the like, and the rearmost end of the falling object reaches the bag body at a later time. When the entire portion of the object for a single bag is dropped all together, the vertical spreading of the object during falling is determined substantially constantly, depending on the properties of the object such as grain size, shape, and weight, the inner diameter and inner surface roughness of the chute pipe, and other factors. (iii) The packing-packaging state described in (i) can be achieved by the following manner. The object is dropped using a shutter that opens at high speed so that the vertical spreading of the falling object is minimized. In addition, the opening-closing timing of the shutter and the timing of the formation of horizontal bonding are controlled such that a falling path is closed with a pressing member or a bonding head for forming the horizontal bonding after the rearmost end of the falling object passes through the position for forming the horizontal bonding. In this manner, the rate of packing-packaging can be drastically improved.

Accordingly, the present invention provides a packing-packaging machine comprising:

a horizontal bonding unit for forming bonding at predetermined intervals on a tubular body formed from a packaging sheet to thereby form a bag body, the bonding being formed in a direction of a width of the tubular body (the bonding hereinafter being referred to as horizontal bonding); and an object dispensing unit for, during a repetition of formation of the horizontal bonding, dropping a predetermined amount of an object to be packaged, into the bag body to pack the bag body with the object, wherein the object dispensing unit comprises a shutter for opening and closing a falling path of the predetermined amount of the object into the bag body, and the shutter is opened and closed such that the predetermined amount of the object and another predetermined amount of the object fall with a spacing therebetween, and that before the horizontal bonding is formed on the bag body packed with the predetermined amount of the object which has been dropped during opening-closing operation of the shutter, the other predetermined amount of the object for a next bag body starts falling.

The present invention also provides a method for packing and packaging an object to be packaged, the method comprising: forming horizontal bonding at predetermined intervals on a tubular body of a packaging sheet to thereby form a bag body; and, during a repetition of formation of the horizontal bonding, dropping a predetermined amount of the object into the bag body to pack the bag body with the object, wherein a falling path of the predetermined amount of the object into the bag body is opened and closed using a shutter, and the shutter is opened and closed such that the predetermined amount of the object and another predetermined amount of the object fall with a spacing therebetween, and that before the horizontal bonding is formed on the bag body packed with the predetermined amount of the object which has been dropped during opening-closing operation of the shutter, the other predetermined amount of the object for a next bag body starts falling.

Effects of the Invention

In the packing-packaging machine and method of the present invention, a predetermined amount of an object to be packaged is dropped into a bag body by opening and closing the shutter to pack the bag body with the object. This can eliminate the problem of pulverization of the object that occurs when the object is tea leaves and an auger screw is used.

Moreover, after a predetermined amount of the object is dropped into a bag body by opening and closing the shutter and before horizontal bonding is formed on the bag body packed with the predetermined amount of the object, another predetermined amount of the object for a next bag body is dropped. Therefore, the packing-packaging rate of bag bodies is not limited by the period of time after a predetermined amount of the object starts falling until it reaches a bag body. Accordingly, the packing-packaging rate of bag bodies can be drastically improved. For example, 200 or more tea bags can be produced per minute.

DESCRIPTION OF REFERENCE NUMERALS

Figure 1:
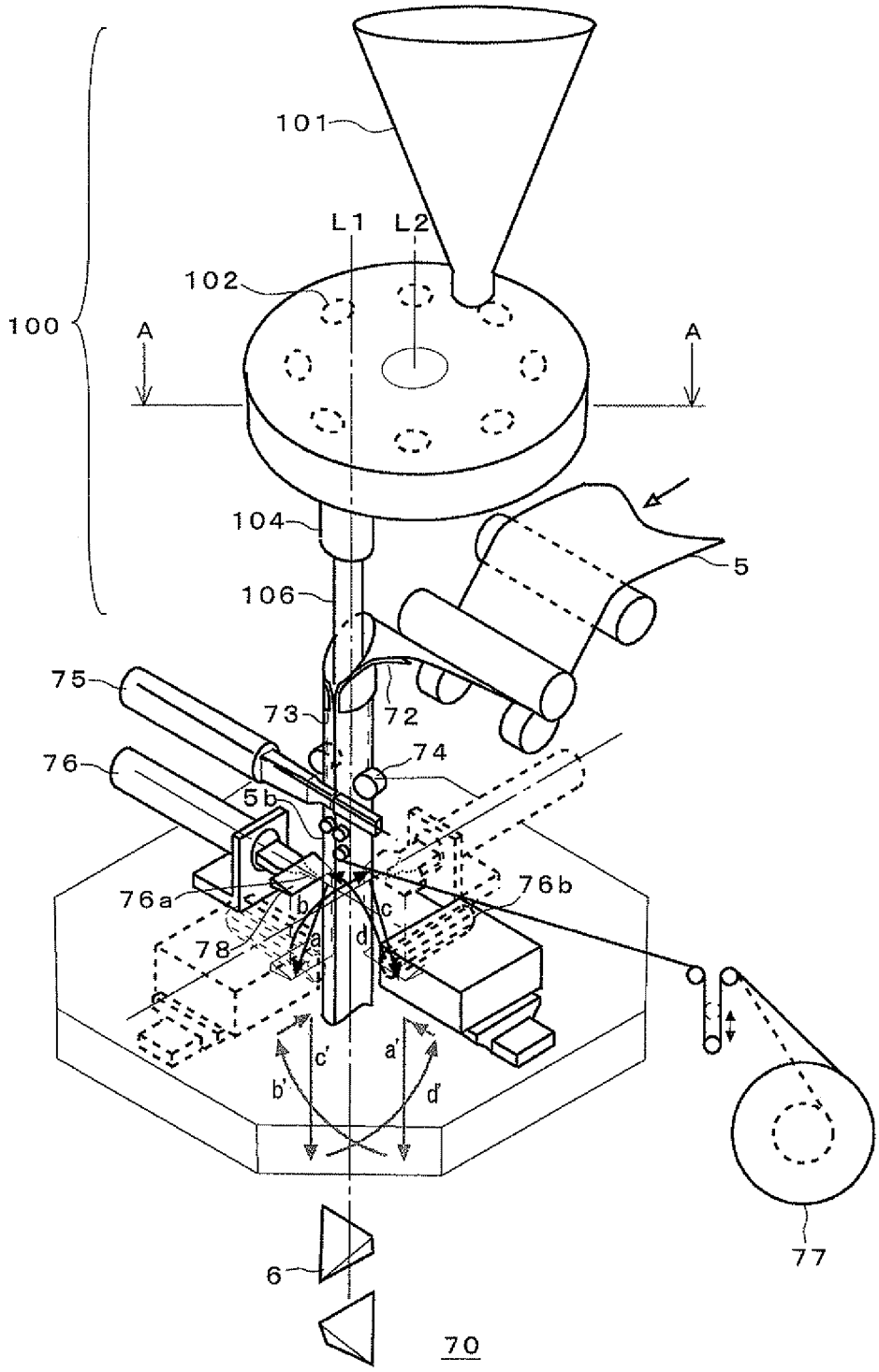
FIG. 1 is a schematic general view of a packing-packaging machine.

5 extraction bag sheet
5*b* tubular body
6 extraction bag
70 packing-packaging machine
72 forming guide
73 cylindrical body
74 feeding roller
75 vertical bonding unit
76 horizontal bonding unit
76*a* bonding head (ultrasonic horn)
76*b* anvil
77 scrap rolling means
78 pressing member
85 object to be packaged
100, 100B object dispensing unit
101 hopper
102 measure
102B pair of measures
103 measure shutter
103*a* cam follower
103*b* spring
104 intermediate hopper
104*a* inner wall
104*b* inner wall
104*c* region
105 intermediate hopper shutter
106 chute pipe
110 rotary table
111 strickle
112 sweeping plate
120 shutter opening-closing unit
121 rotary cam
122 triangular plate
123 arm
124 cam-like member
130 base
131 variable speed motor
132 link mechanism
133 set shutter
L1 axis of tubular body of extraction bag sheet
L2 rotation axis

BEST MODE FOR CARRYING OUT THE INVENTION

Hereinafter, the present invention will be specifically described with reference to the drawings. In the drawings, the same reference numerals denote the same or similar elements.

FIG. 1 is a schematic general view of a packing-packaging machine 70 in an embodiment of the present invention.

This packing-packaging machine 70 is a machine for manufacturing tetrahedral extraction bags 6 using an extraction bag sheet 5, which is used as a packaging sheet. In general, the packing-packaging machine 70 includes: a cylindrical body 73 provided with a forming guide 72 that guides the extraction bag sheet 5; sheet feeding means (feeding rollers 74) for allowing the extraction bag sheet 5 wound around the cylindrical body 73 to run in a downward direction at a constant speed; a vertical bonding unit 75 for forming vertical bonding by welding opposite lengthwise edge portions of the extraction bag sheet 5 to each other, whereby the extraction bag sheet 5 is shaped into a tubular body 5*b*; a horizontal bonding unit 76 for welding and cutting the tubular body 5*b*, which is running downward at a constant speed, in two different directions intersecting each other as viewed from above to form first horizontal bonding and second horizontal bonding in an alternating manner; and an object dispensing unit 100 configured such that, during an alternate repetition of the formation of first horizontal bonding and the formation of second horizontal bonding, a predetermined amount of tea leaves or a similar product, which are used as the contents of an extraction bag and supplied from a hopper 101, is measured into a measure 102 and dropped into a chute pipe 106 through an intermediate hopper 104 to thereby pack the tubular body of the extraction bag sheet 5 with the tea leaves or a similar product.

The vertical bonding unit 75 includes an ultrasonic welding-cutting unit and also includes scrap rolling means 77 for rolling an unnecessary edge portion (selvage portion) generated when the vertical bonding is formed.

The horizontal bonding unit 76 includes one ultrasonic welding-cutting unit configured such that its welding-cutting direction is changed oscillatingly by a predetermined angle (preferably 90°) around the axis L1 of the tubular body 5*b* of the extraction bag sheet 5 each time after horizontal bonding is formed. The ultrasonic welding-cutting unit is moved so as to be located at positions shown by solid and dotted lines in FIG. 1 in an alternating manner. The ultrasonic welding-cutting unit includes: an ultrasonic horn 76*a* having a tapered protruding end and used as a bonding head; a columnar anvil 76*b*; and a pressing member 78 for flattening the tubular body of the extraction bag sheet 5 when horizontal bonding is formed.

The pressing member 78 has a width corresponding to the width of horizontal bonding to be formed. When horizontal bonding is formed, the pressing member 78 advances to a position on the axis L1, flattens the tubular body 5*b* of the extraction bag sheet 5 at positions above and below the bonding head 76*a*, and is moved downwardly together with the tubular body 5*b* of the extraction bag sheet 5. After formation of the horizontal bonding, the pressing member 78 is moved to a return position at which the downward running distance of the tubular body 5*b* of the extraction bag sheet 5 during the formation of the horizontal bonding is cancelled.

The bonding head 76*a* has a tapered protruding end and is of a so-called traveling type in which the head travels so that bonding can be formed to any desired length. The use of the traveling-type bonding head allows a reduction in its size and weight. Therefore, the bonding head can be easily driven at fast speed, and the driving mechanism therefor can be made compact.

With the tubular body 5*b* of the extraction bag sheet 5 flattened with the pressing member 78, the bonding head 76*a* abuts against the tubular body 5*b* and travels in the width direction of the flattened tubular body 5*b* and also in a downward direction. In this manner, horizontal bonding is formed without stopping the downwardly running tubular body 5*b*, while the running speed of the tubular body 5*b* is maintained constant. After formation of the horizontal bonding, the bonding head 76*a* is moved to a return position at which the downward running distance of the tubular body 5*b* during the formation of the horizontal bonding is cancelled.

Therefore, the overall movement of the bonding head 76*a* is such that when the first horizontal bonding is formed, the bonding head 76*a* is moved obliquely downwardly as shown by an arrow a as a result of a combination of the above widthwise movement and the above downward movement. After formation of the first horizontal bonding, the bonding head 76*a* is moved upwardly so as to cancel the downward running distance of the tubular body 5*b* of the extraction bag sheet 5 during the formation of the first horizontal bonding and is rotated 90° about the axis L1 to a return position, as shown by an arrow b. Next, the bonding head 76*a* is moved obliquely downwardly as shown by an arrow c to form second horizontal bonding in a manner similar to the formation of the first horizontal bonding and then moved to another return position, as shown by an arrow d.

The anvil 76*b* does not travel in the horizontal direction during the formation of horizontal bonding but travels in the vertical direction in synchronization with the bonding head 76*a*. More specifically, as shown in FIG. 1, the anvil 76*b* is moved downwardly together with the tubular body 5*b* of the extraction bag sheet 5 as shown by an arrow a' when the first horizontal bonding is formed. Then the anvil 76*b* first moves back to a position at which the anvil 76*b* is prevented from being in contact with the tubular body 5*b*. During this movement, the anvil 76*b* is moved upwardly so as to cancel the downward running distance during the formation of the first horizontal bonding and is rotated 90° about the axis L1 to a return position, as shown by an arrow b'. Next, the anvil 76*b* advances to a position on the axis L1, is moved downwardly as shown by an arrow c' during the formation of second horizontal bonding and then moved to another return position, as shown by an arrow d'. Then the formation of first horizontal bonding and the formation of second horizontal bonding are repeated.

By moving the bonding head 76*a* and the anvil 76*b* in the manner described above, the tubular body 5*b* of the extraction bag sheet 5 can be continuously fed during the formation of horizontal bonding without causing intermittent movement. Therefore, the production rate of extraction bags can be improved.

The above movement of the horizontal bonding unit 76 can be achieved by driving a cam mechanism and a link mechanism using a servo motor. In such a case, the running speeds of the bonding head 76*a*, the columnar anvil 76*b*, and the pressing member 78, when they are in contact with the tubular body 5*b*, are preferably controlled so as to be the same as the running speed of the tubular body 5*b* of the extraction bag sheet 5. This can avoid the pulsation of the running speed of the tubular body 5*b* of the extraction bag sheet 5 and the meandering thereof, so that regularly shaped tetrahedral extraction bags 6 can be manufactured.

Thermal welding-cutting units may be used instead of the ultrasonic welding-cutting units used in the vertical bonding unit 75 and the horizontal bonding unit 76.

Figure 2:
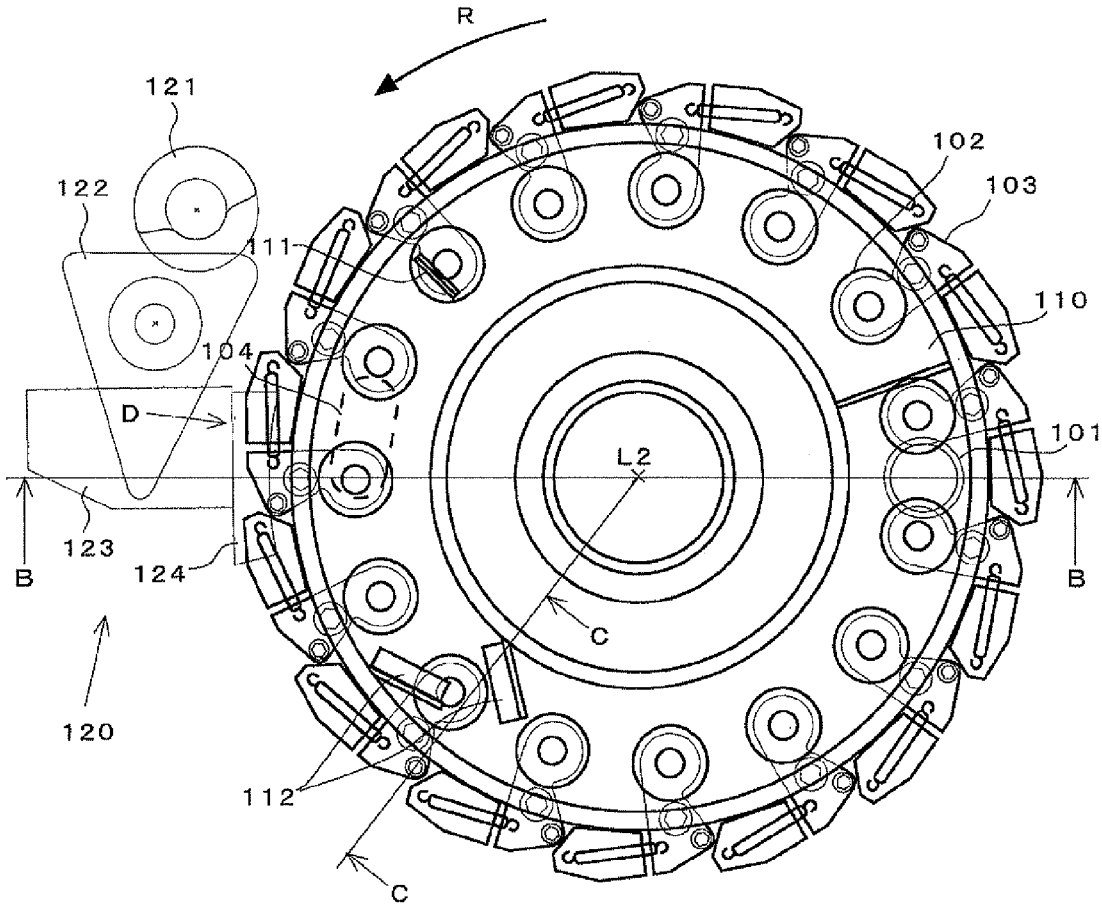
FIG. 2 is a horizontal cross-sectional view showing the vicinity of measures of the packing-packaging machine.
Figure 3A:
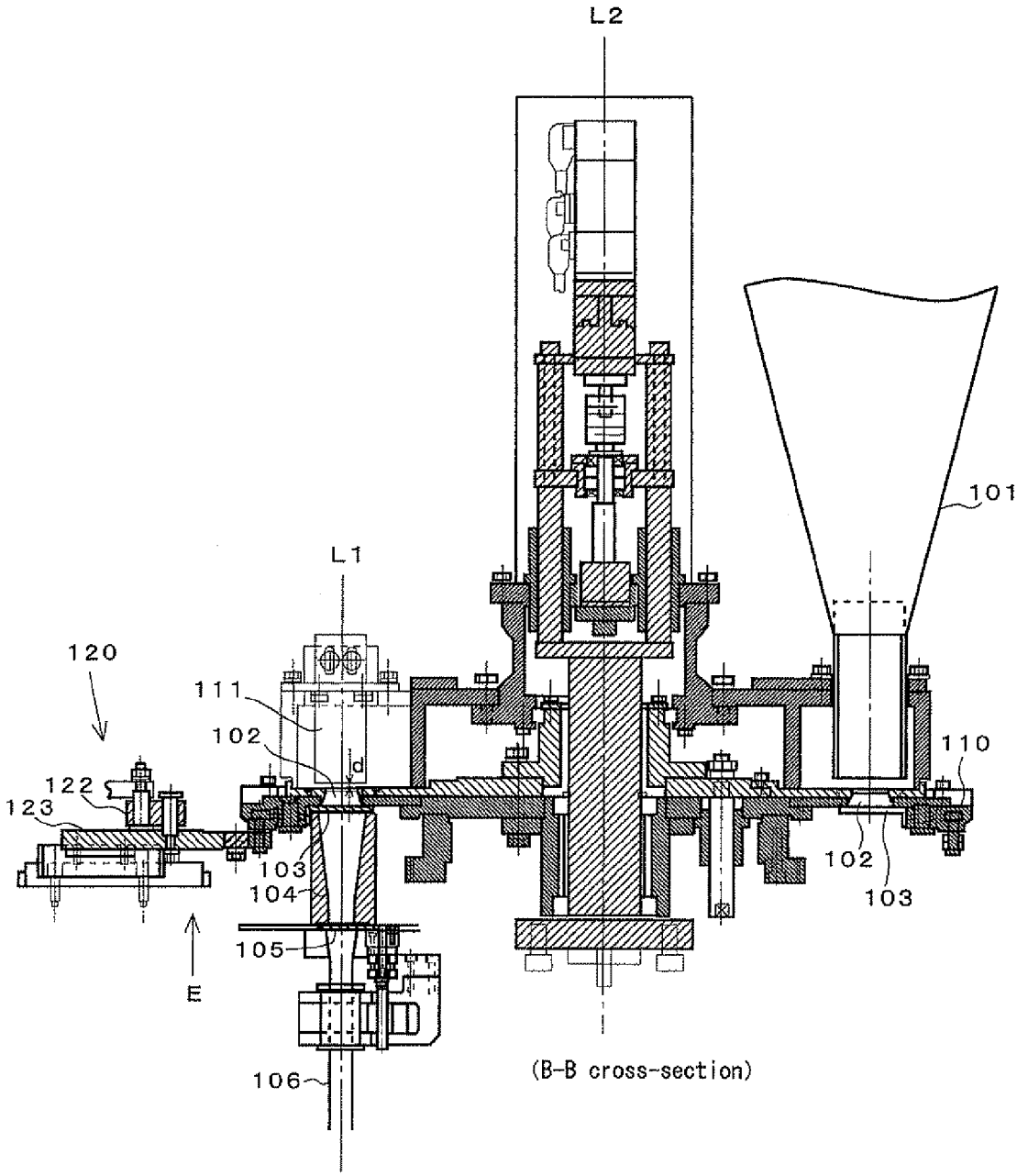
FIG. 3A is a vertical cross-sectional view showing the vicinity of a shutter opening-closing unit of the packing-packaging machine.
Figure 3B:
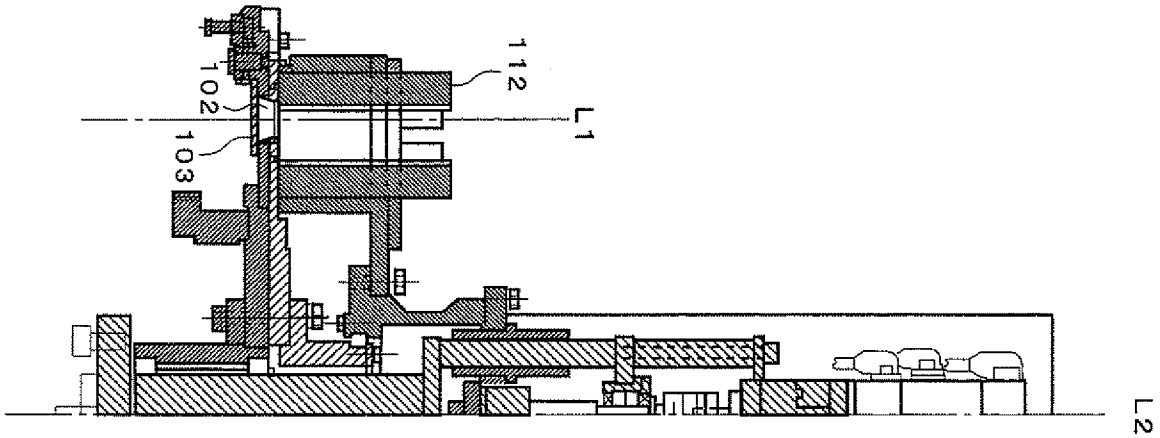
FIG. 3B is a vertical cross-sectional view showing the vicinity of sweeping plates of the packing-packaging machine.

In the packing-packaging machine 70, the object dispensing unit 100 is configured such that while the formation of first horizontal bonding and the formation of second horizontal bonding are repeated in an alternating manner, the object to be packaged, such as tea leaves, is packed into bag bodies of the extraction bag sheet 5 that are formed through the formation of the horizontal bonding. As shown in FIGS. 2, 3A, and 3B, the object dispensing unit 100 includes: the hopper 101 for storing the object to be packaged such as tea leaves; the measures 102 for dispensing a predetermined amount of the object; the intermediate hopper 104 for temporarily storing the object fed from a measure 102; and the chute pipe 106 extending from the discharge hole of the intermediate hopper 104 to a position just above the pressing member 78 of the horizontal bonding unit 76.

The measures 102 are formed by drilling cylindrical holes in a rotary table 110 at regular intervals in the circumferential direction thereof as shown in FIG. 2, and a measure shutter 103 is provided on the bottom of each measure 102 so that the discharge hole thereof is opened and closed. The rotary table 110 is rotated about an axis L2 at a constant speed in the direction of an arrow. When one of the measures 102 is placed below the hopper 101 during the rotation of the rotary table 110, this measure 102 closed by its measure shutter 103 is filled with the object to be packaged, such as tea leaves, and an excess portion of the object over the measure is removed by a strickle 111, so that a predetermined amount of the object into a single bag is measured into the measure. When a shutter opening-closing unit 120 opens the measure shutter 103, the predetermined amount of the object in the measure 102 falls by its own weight into the intermediate hopper 104. The strickle 111 is attached such that its position is adjustable upward and downward, so that the gap d between the strickle 111 and the measures 102 can be adjusted according to the grain size of the object to be packaged, such as tea leaves. After the object in a measure 102 is dropped by its own weight, the object remaining on the rotary table 110 is collected into measures 102 by sweeping plates 112 and is used as a part of the object to be subsequently dropped by its own weight.

The present invention is characterized in that the measure shutters 103 are controlled to open and close in the following manner. Before completion of horizontal bonding on a bag body packed with a predetermined amount of the object dropped during the opening-closing operation of one of the shutters, predetermined amount of the object measured into a next measure starts falling. In this case, predetermined amounts of the object fall through the chute pipe 106 (a falling path) one after another. Therefore, a plurality of measured portions of the object can be present in the chute pipe simultaneously. The measure shutters 103 are opened and closed at fast speed such that the plurality of measured portions are dropped at intervals. In this manner, the object to be packaged can be packed and packaged at a faster rate than conventional rates, so that the production rate of extraction bags can be increased. For example, when 200 extraction bags are produced per minute, the packing-packaging time for one bag is 0.3 seconds. By fully opening a closed measure shutter 103 in about 0.03 seconds, such high-speed packing-packaging can be achieved, as described later.

However, when the opening speed of the measure shutters 103 is low, the falling object to be packaged spreads vertically in the chute pipe 106. Therefore, it is difficult to ensure a sufficient spacing between the predetermined amounts of the falling object.

Figure 4:
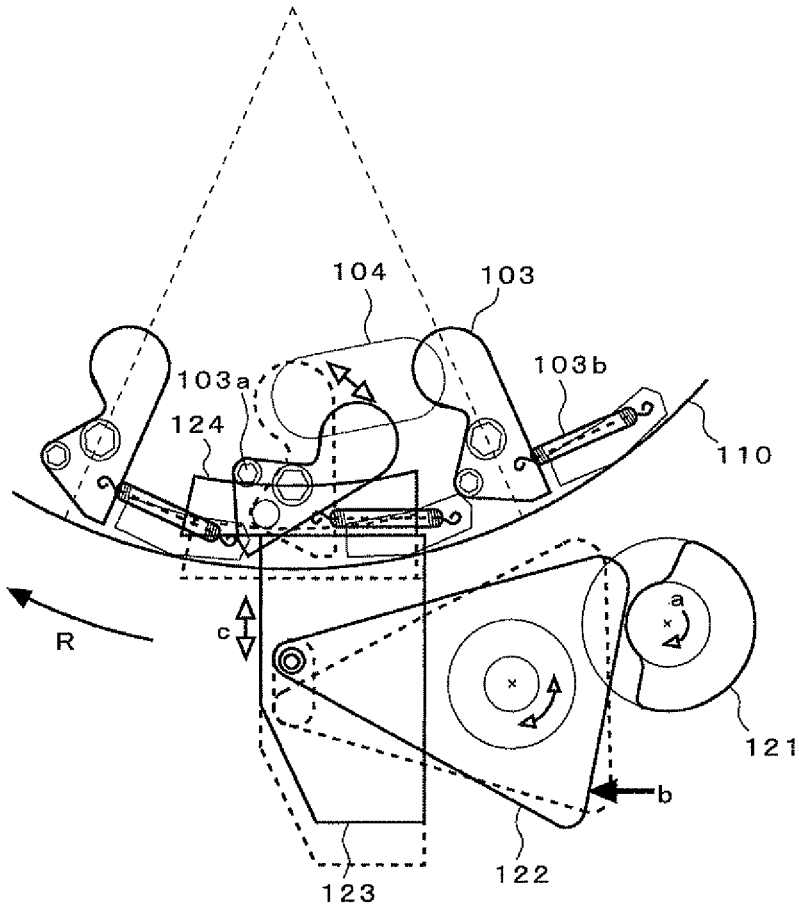
FIG. 4 is a view taken in the direction of an arrow, showing the shutter opening-closing unit.

FIG. 4 is a view taken in the direction of an upward E pointing to the rotary table 110, illustrating the shutter opening-closing unit 120 suitable for opening and closing the measure shutters 103 at high speed in the manner described above. The shutter opening-closing unit 120 includes: a rotary cam 121 that is rotated by a variable speed motor in the direction of an arrow a; a triangular plate 122 that is attached so as to be oscillatingly movable; a cylinder (not shown) for pressing the triangular plate 122 in the direction of an arrow b; an arm 123 that is reciprocated in the direction of an arrow c in response to the oscillation of the triangular plate 122; and a cam-like member 124 attached to one end of the arm 123. Each measure shutter 103 is attached to the rotary table 110 so as to be oscillatingly movable and has a cam follower 103*a* that comes in sliding contact with an end surface of the cam-like member 124. A spring 103*b* is provided so as to bias the measure shutter 103 to a position at which the discharge hole of the measure 102 is closed unless an external force is applied to the measure shutter 103.

In the shutter opening-closing unit 120, when the rotary cam 121 is rotated in the direction of the arrow a, the triangular plate 122 is moved oscillatingly, so that the cam-like member 124 attached to the end of the arm 123 is reciprocated in the direction of the arrow c. The rotary table 110 is rotated in the direction of an arrow R at a constant speed. Therefore, when the cam follower 103*a* of one of the measure shutters 103 is moved to a position at which it comes into contact with the cam-like member 124, the movement of the cam-like member 124 in a direction toward the rotary table 110 causes the cam follower 103*a* to be pushed toward the center of the rotary table 110, whereby the measure shutter 103 is opened. Then, when the cam-like member 124 moves in a direction away from the rotary table 110, the action of the spring 103*b* causes the measure shutter 103 to close. Therefore, the cam-like member 124 moving reciprocally allows the measure shutters 103 to open and close.

If a measure shutter 103 is opened and closed using a fixed cam provided at a position at which it comes into sliding contact with the cam follower 103*a* of the measure shutter, the fixed cam must be designed such that a displacement corresponding to the distance of the reciprocal movement of the cam-like member 124 is provided within the distance corresponding to the width of the cam-like member 124. In this case, the pressure angle is 60° or more, and an excessive load is applied to the components. In addition, this results in an increase in power loss. Therefore, it is difficult to open and close a measure shutter 103 at high speed using such a fixed cam. However, the use of the cam-like member 124 that reciprocates as described above allows the measure shutters 103 to open and close at high speed.

Figure 5:
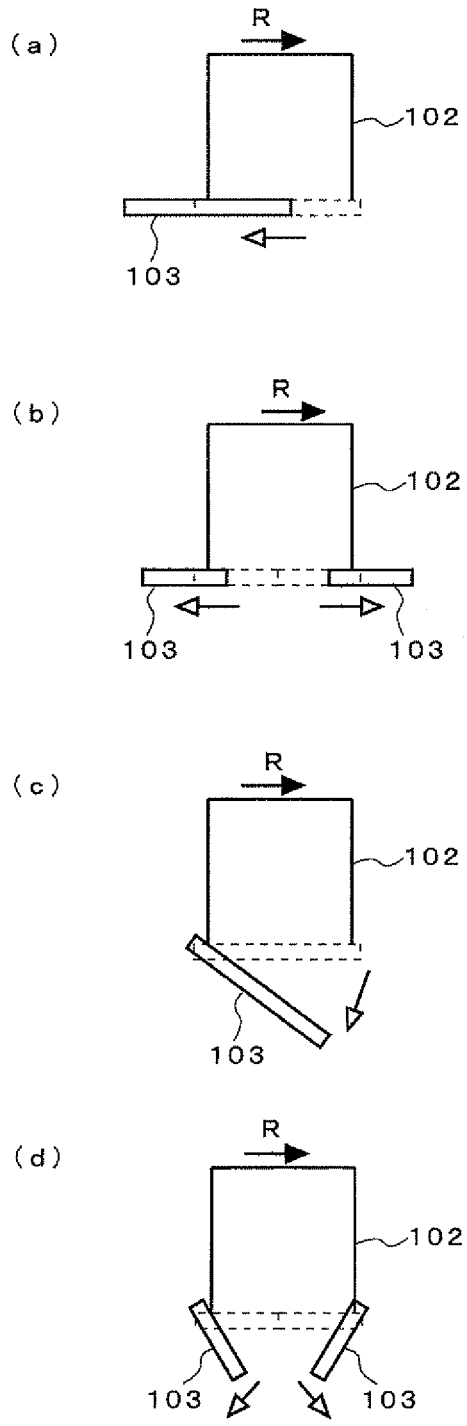
FIG. 5 is a set of diagrams illustrating the manners of opening a measure shutter.

Preferably, the direction of opening a measure shutter 103 (indicated by a white arrow) using the shutter opening-closing unit 120 is opposite to the running direction R of the object to be packaged (indicated by a black arrow) when the measure shutter 103 is opened (i.e., is opposite to the running direction of the measure 102 when the measure shutter 103 is opened), as shown in FIG. 5(*a*). It is not preferable to set the direction of opening the measure shutter 103 to be the same as the running direction of the object to be packaged because the size of the inlet opening of the chute pipe 106 or the inlet opening of the intermediate hopper 104 must be increased accordingly.

In the present invention, no particular limitation is imposed on the manner of opening and closing the shutter to drop the predetermined amount of the object to be packaged into the falling path therefor formed from the intermediate hopper 104, the chute pipe 106, and the like. The shutter may be allowed to slide in one direction as described above in FIG. 5(*a*). In addition, the shutter may be allowed to slide in opposite directions as shown in FIG. 5(*b*), may be supported by a hinge so as to open in one direction as shown in FIG. 5(*c*), or may be composed of hinged double doors as shown in FIG. 5(*d*). To simplify the opening-closing mechanism for the shutter, it is preferable to slide the shutter in one direction as shown in FIG. 5(*a*).

The intermediate hopper 104 is provided to suppress the vertical spreading of the object to be packaged in the falling path when the object is dropped by its own weight into the falling path from a measure 102 formed in the rotary table 110 rotating at a constant speed. The intermediate hopper 104 is formed into a particular shape that can allow the horizontal velocity component of the object 85 to be minimized, and an intermediate hopper shutter 105 used as a second shutter is provided on the discharge hole of the intermediate hopper 104.

Figure 6:
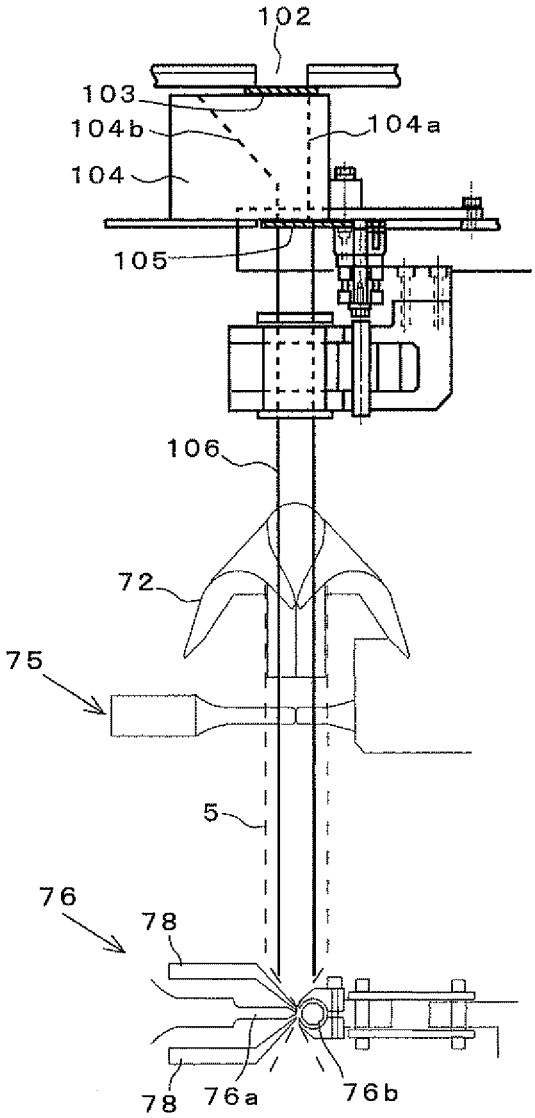
FIG. 6 is a view taken in the direction of an arrow, showing the vicinity of an intermediate hopper shutter.
Figure 7:
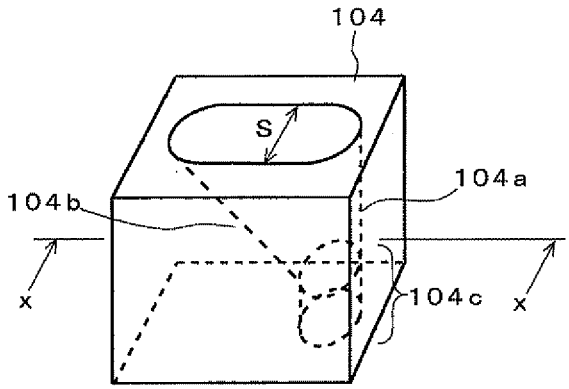
FIG. 7 is a perspective view of an intermediate hopper.
Figure 8:
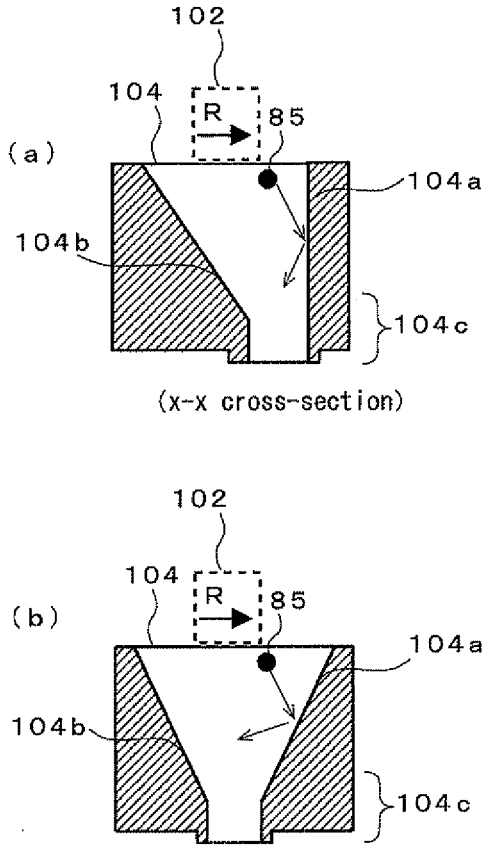
FIG. 8 is a set of cross-sectional views of intermediate hoppers.
Figure 9A:
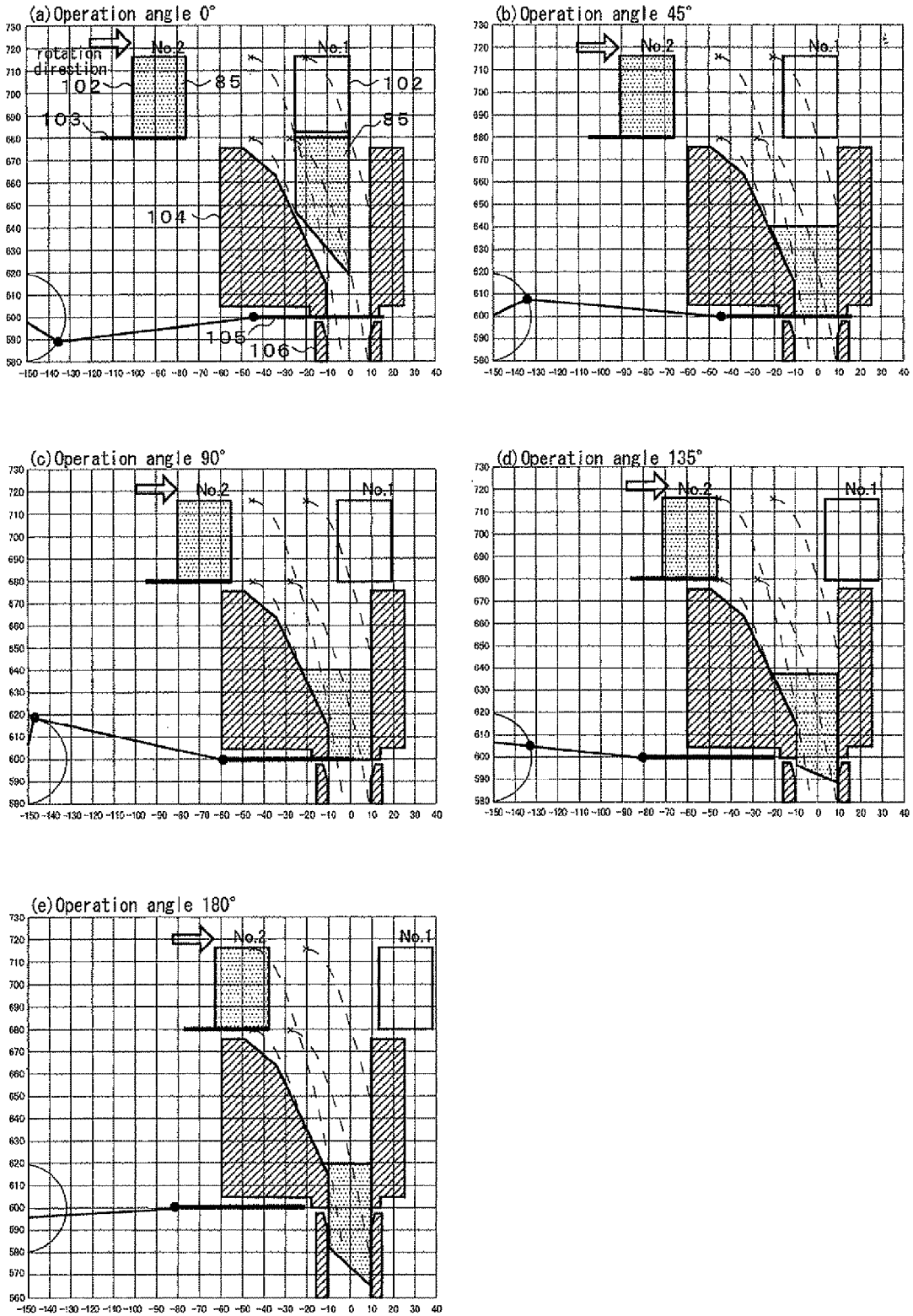
FIG. 9A is a series of diagrams illustrating the operation of an object dispensing unit.
Figure 9B:
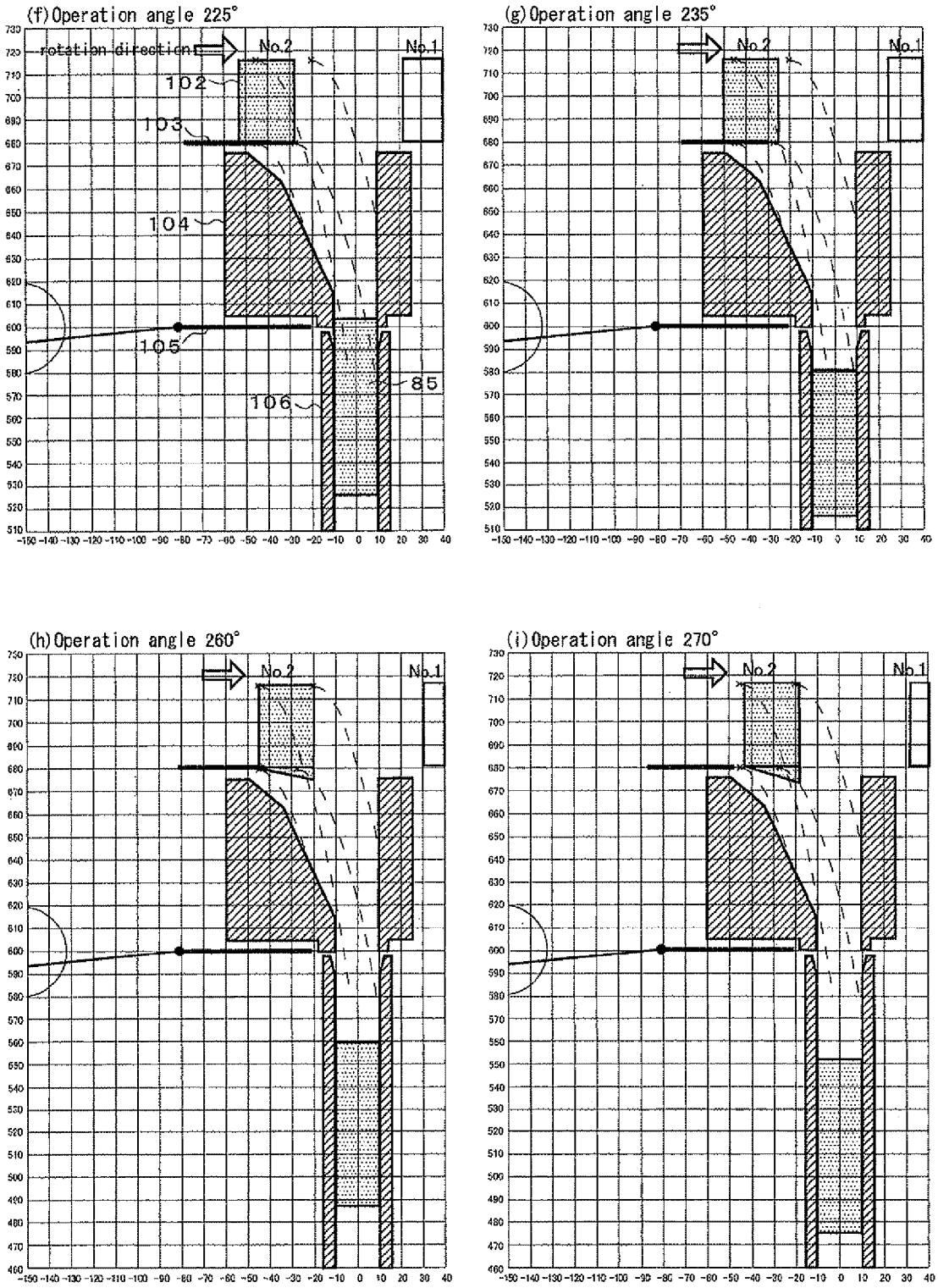
FIG. 9B is a series of diagrams illustrating the operation of the object dispensing unit.
Figure 9C:
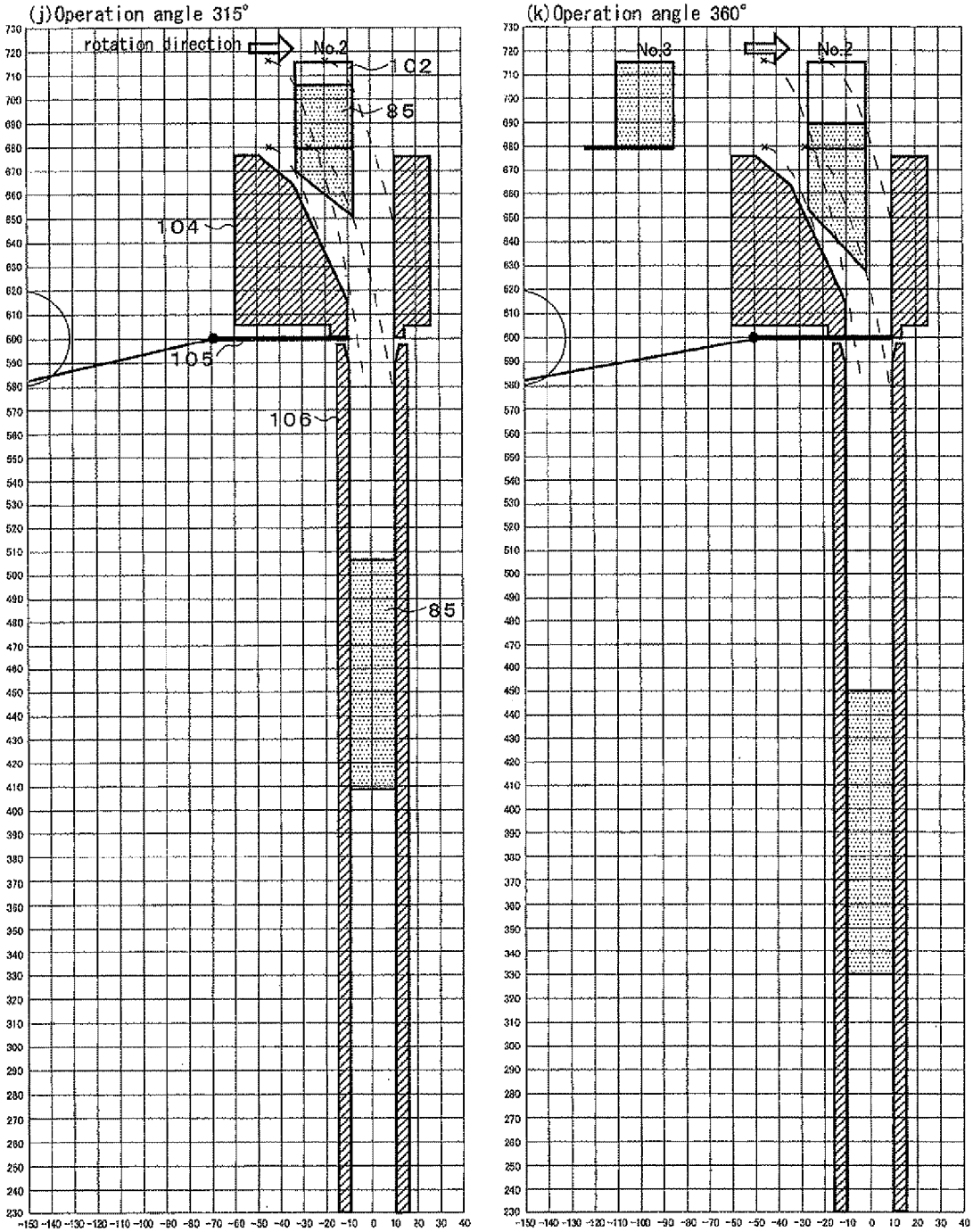
FIG. 9C is a series of diagrams illustrating the operation of the object dispensing unit.
Figure 9D:
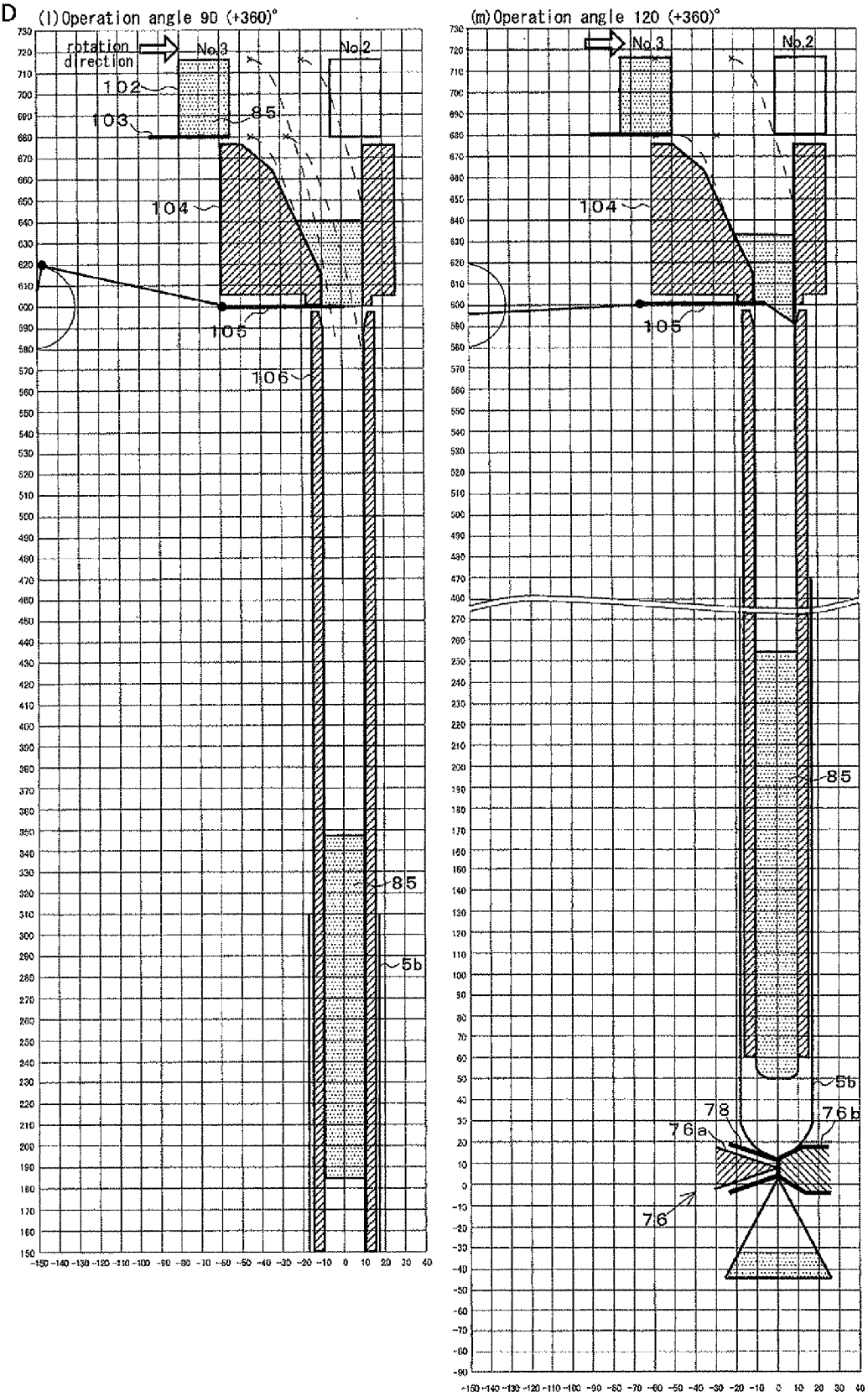
FIG. 9D is a series of diagrams illustrating the operation of the object dispensing unit.
Figure 9E:
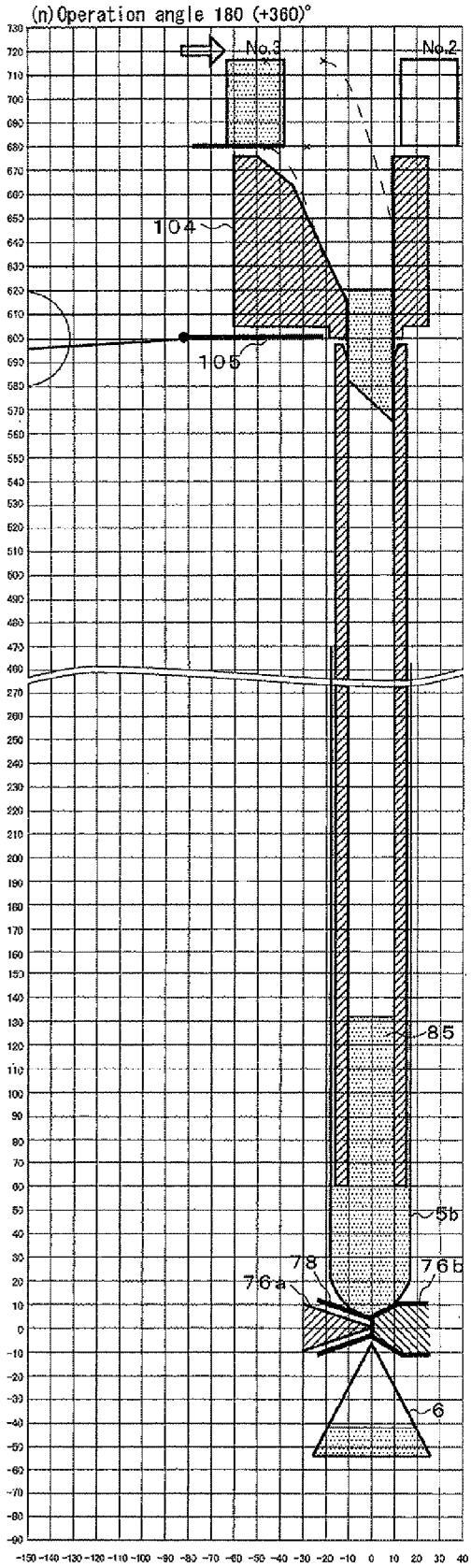
FIG. 9E is a diagram illustrating the operation of the object dispensing unit.

Preferably, as shown in FIG. 6 (a view taken by an arrow in D direction in FIG. 2), FIG. 7 (a perspective view of the intermediate hopper 104), and FIG. 8(*a*) (a cross-sectional view of FIG. 7), the intermediate hopper 104 is formed such that its inner wall 104*a* on the upstream side in the running direction of a measure 102 (the rotation direction R of the rotary table 110) at the opening-closing position of its measure shutter 103 is a vertical wall. In addition, an inner wall 104*b* of the intermediate hopper 104 on the downstream side in the running direction of the measure 102 is preferably an inclined wall.

As described above, the inner wall 104*a* of the intermediate hopper 104 on the upstream side in the running direction of the measure 102 (the rotation direction R of the rotary table 110) is formed so as to be perpendicular to the running direction R of the measure 102. In this case, the vertical velocity component of the object 85 dropped from the measure 102 decreases very little when the object 85 impinges on the inner wall 104*a*, as shown in FIG. 8(*a*). However, if the inner wall 104*a* of the intermediate hopper 104 on the upstream side in the running direction R of the measure 102 is inclined upward as shown in FIG. 8(*b*), the vertical velocity component of the object 85 dropped from the measure 102 and impinging on the inner wall 104*a* decreases. This is not preferred because the object is likely to spread vertically in the falling path.

Desirably, the intermediate hopper 104 is formed such that its lower region 104*c* in which the object to be packaged is accumulated has a substantially straight shape, i.e., has a vertically extending inner wall. This allows a reduction in the discharge time required to completely discharge the object 85 that is accumulated in the intermediate hopper 104 and starts falling by its own weight when the intermediate hopper shutter 105 is opened. However, if the inner wall in the lower region is inclined, the discharge time becomes long. This is not preferable because the object falls while spreading vertically in the chute pipe 106.

Preferably, the intermediate hopper 104 is formed such that its region above the region 104*c* has a flat ellipsoidal or oval horizontal cross-section with a minor axis S substantially the same as the diameter of the chute pipe 106. This prevents the object fed to the chute pipe 106 through the intermediate hopper 104 from having an additional velocity component in the direction of the minor axis S, so that the vertical spreading of the object in the falling path can be suppressed.

The intermediate hopper shutter 105 is provided so that it temporarily accumulates the object dropped by its own weight from a measure 102 formed in the rotary table rotated at a constant speed so as to eliminate the horizontal velocity component, and the object is again dropped by its own weight. Therefore, preferably, the timing of opening and closing the intermediate hopper shutter 105 is controlled in relation to the timing of opening and closing the measure shutter 103.

In the present invention, the intermediate hopper 104 and the intermediate hopper shutter 105 are not required to be provided in the following cases: The rotary table 110 is not rotated at a constant speed but is rotated intermittently, and a measure shutter 103 is opened with the movement of the measures 102 stopped; The object to be packaged does not have any horizontal velocity component when a measure shutter is opened to allow the object to fall (for example, the measure shutter is opened when a measure reciprocating intermittently stops moving, as in an embodiment described later). However, if the rotary table 110 is rotated intermittently, the packing-packaging machine must be configured so as to have high mechanical shock resistance, and its driving power must be increased. This increases the manufacturing cost and maintenance cost of the packing-packaging machine.

Preferably, the inner wall of the chute pipe 106 is subjected to friction reducing treatment or antistatic treatment so that the resistance of the object falling through the chute pipe 106 is reduced to suppress the vertical spreading of the object in the chute pipe 106. Examples of the friction reducing treatment include satin finishing treatment, formation of vertical grooves, and application of a friction reducing agent.

Preferably, an air inlet hole is provided in some mid portion of the chute pipe 106. In the chute pipe 106, the falling speed of a first portion of the object to be packaged is greater than the falling speed of a second portion of the object that follows the first portion of the object. Therefore, when no air inlet hole is provided, a negative pressure generated between the first and second portions of the object acts so as to reduce the spacing therebetween. In particular, the rear end of the first portion of the object is dragged, and the distance between the rear end of the first portion of the object and the front end of the second portion of the object is reduced. However, when an air inlet hole is provided, the distance between the portions of the object for single bags that fall through the chute pipe 106 one after the other can be easily ensured.

The chute pipe 106 is not necessarily disposed so as to extend from a position immediately below a measure shutter 103 or the intermediate hopper shutter 105 to a position immediately above the pressing member 78 of the horizontal bonding unit 76. However, the chute pipe 106 must be disposed so as to extend at least to a position at which the extraction bag sheet 5 is shaped into the tubular body 5*b*. To eliminate the possibility that the object falling through the falling path adheres to the extraction bag sheet 5 and is caught in horizontal bonding during the formation thereof, it is preferable to dispose the chute pipe 106 so as to extend to a position immediately above the formation point of the horizontal bonding.

FIGS. 9A to 9D are series of diagrams illustrating the operation of the hopper 101 and the intermediate hopper 104. In these figures, an operation angle is an angle defined by dividing one operational cycle of one of the measures 102 formed in the rotary table 110 at regular intervals into 360°. The vertical axes represent the distance (mm) from a midpoint between a point at which the pressing member 78 of the horizontal bonding unit 76 starts pressing the extraction bag sheet and a point at which the pressing member 78 releases the extraction bag sheet. The horizontal axes represent the distance (mm) from the center axis of the chute pipe 106. Broken lines represent the falling trajectories of the reference points (the front ends and rear ends in the falling direction) of the object 85 to be packaged.

A measure (No. 1) 102 filled with the object 85 to be packaged is moved above the intermediate hopper 104 through the rotation of the rotary table 110, and the measure shutter 103 for the measure (No. 1) 102 is opened, whereby the object 85 is allowed to fall by its own weight and fed to the intermediate hopper 104. At this time, the intermediate hopper shutter 105 is in a closed state, so that the fed object 85 stays in the intermediate hopper 104 (FIGS. 9A(*a*), and 9A(*b*)). After or shortly before the entire amount of the object 85 in the measure 102 is accumulated in the intermediate hopper 104, the intermediate hopper shutter 105 starts opening (FIG. 9A(*c*)) to allow the accumulated object 85 to fall by its own weight into the chute pipe 106. The intermediate hopper shutter 105 is held fully open (FIGS. 9A(*d*) to 9C(*j*)) so that the object 85 in the intermediate hopper is fully discharged. While the object 85 is falling through the chute pipe 106, a next measure (No. 2) 102 is moved above the intermediate hopper 104 (FIGS. 9A(*c*), (*d*), and (*e*)) When the next measure (No. 2) comes close to a predetermined position, the measure shutter 103 for the next measure starts opening (FIG. 9B(*g*)) and fully opens (FIG. 9B(*h*)). The object 85 in the measure (No. 2) 102 falls through the opened measure shutter 103 into the intermediate hopper 104 (FIG. 9B(*i*)). Before the object from the measure (No. 2) 102 reaches the bottom of the intermediate hopper 104, the closing operation of the intermediate hopper shutter 105 is completed (FIG. 9C(*k*)), and the object 85 is again accumulated in the intermediate hopper 104. While the object 85 from the measure (No. 1) 102 is passing through the chute pipe 106, the intermediate hopper shutter 105 starts opening (FIG. 9D(*l*)), and the object 85 fed from the measure (No. 2) and accumulated in the intermediate hopper 104 is allowed to fall into the chute pipe 106. During the above operation, a tubular body 5*b* packed with the object 85 from a measure preceding the measure (No. 1) is sealed by forming horizontal bonding. More specifically, first, a portion to be horizontally bonded is pressed with the pressing member 78 of the horizontal bonding unit 76 (FIG. 9D(*m*)). Next, the object 85 from the measure (No. 1) is accumulated on the pressed portion, and an extraction bag 6 is cut by welding (FIG. 9D(*n*)). Then the above procedure is repeated.

Figure 10:
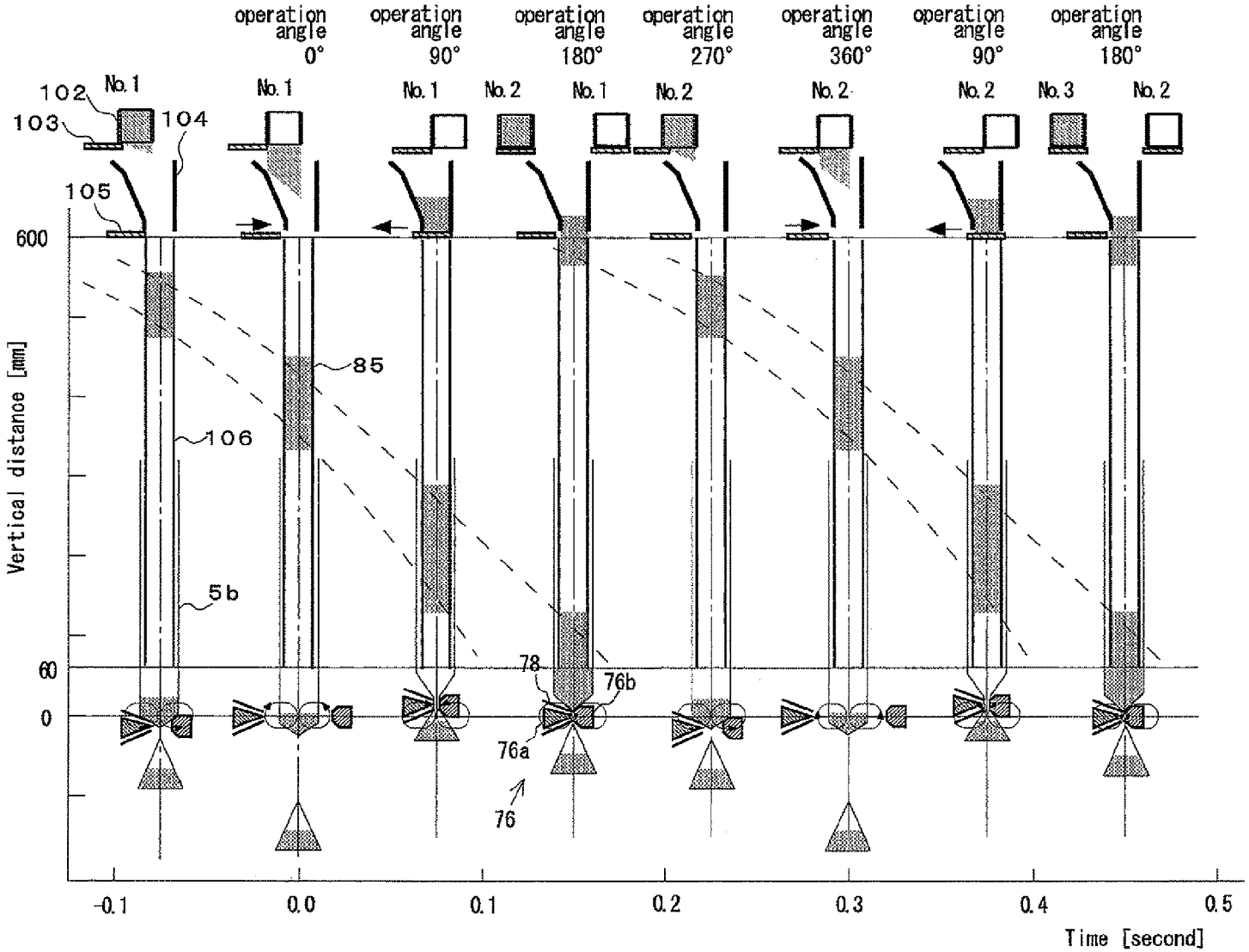
FIG. 10 is a diagram illustrating the dropping states of an object to be packaged inside a chute pipe.

FIG. 10 is a diagram showing the relationship between time and the positions of the object 85 falling in the chute pipe 106 in the manner described above. In the packing-packaging machine 70 of the present embodiment, the measure shutter 103 and the intermediate hopper shutter 105 are opened in a short time (about 0.03 seconds) to feed the object 85 for a first bag measured by the measure 102 into the chute pipe 106. Then the object 85 for a second bag is fed into the chute pipe 106 before horizontal bonding for the first bag packed with the object 85 is completed (more specifically, the falling path of the object for the first bag is closed by the pressing member 78). At this time, the object for the first bag and the object for the second bag fall through the chute pipe 106 with a spacing therebetween. Therefore, with the packing-packaging machine 70, the period of time after the object 85 to be packaged is fed into the chute pipe 106 until a bag body is packed with the object 85 is not rate-limiting, and this does not cause a reduction in production rate of extraction bags.

The extraction bag sheet 5 sent to the packing-packaging machine 70 may be any of various types of long sheets of woven or nonwoven fabric for manufacturing extraction bags and laminates thereof, and string tags may be attached thereto, if necessary.

For example, any string formed of an ultrasonically weldable or thermally weldable material including thermoplastic synthetic fiber such as polypropylene or polyethylene may be used. Any tag formed from paper, a plastic sheet, or the like may be used. Moreover, a water-permeable filter sheet is used. Examples of the water-permeable filter sheet include paper, films having a large number of holes, and woven and nonwoven fabrics formed of single or conjugated fibers selected from synthetic fibers such as polyester, nylon, polyethylene, and polypropylene, semisynthetic fibers such as rayon, and natural fibers such as paper mulberry and *edgeworthia chrysantha*.

Tags and a string may be or may not be attached to the water-permeable filter sheet, and no particular limitation is imposed on the arrangement of the tags and the sting on the water-permeable filter sheet.

An extraction bag sheet 5 wound into a roll may be used. The packing-packaging machine 70 of the present invention may be used in combination with any machine for manufacturing an extraction bag sheet by attaching a hanging string and tags to a water-permeable filter sheet that forms the extraction bag sheet.

The packing-packaging machine of the present invention can be implemented in various embodiments, in addition to the above embodiment. The object dispensing unit in the packing-packaging machine is not limited to a unit that uses measures formed in a rotary table.

Figure 11:
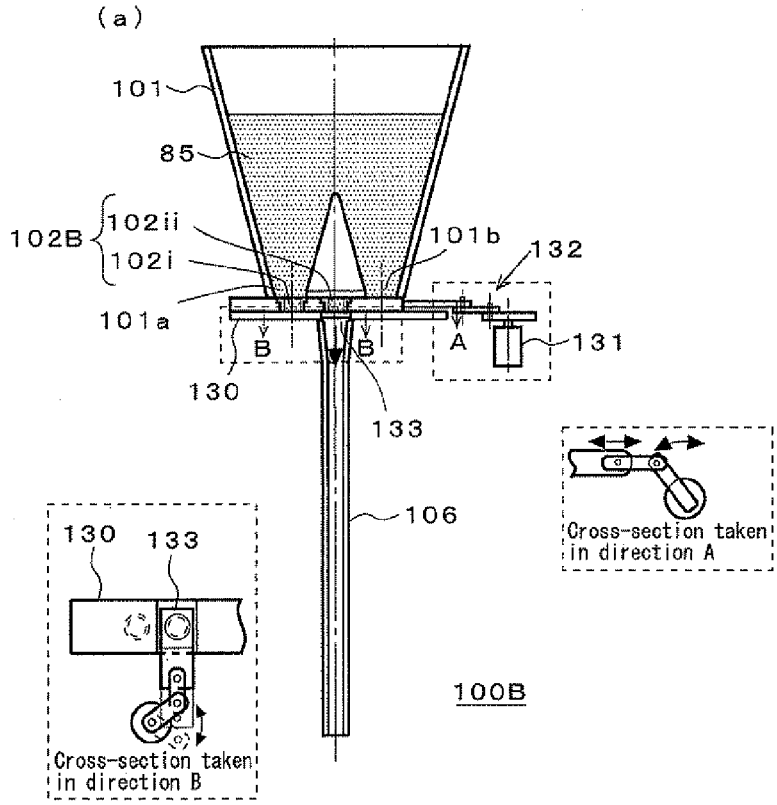
FIG. 11 is a set of cross-sectional views of an object dispensing unit.
Figure 11:
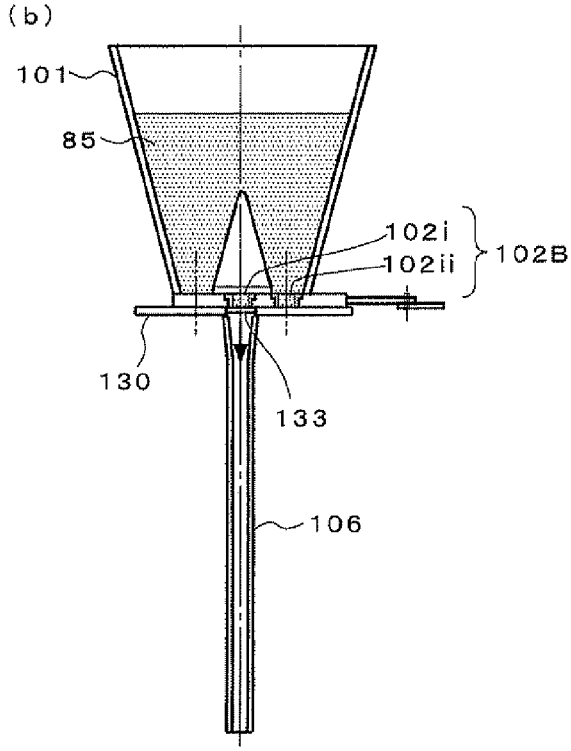

For example, an object dispensing unit 100B shown in FIG. 11 may be used. This object dispensing unit 100B includes a pair of measures 102B (a first measure 102*i* and a second measure 102*ii*) disposed below a hopper 101 for storing the object 85 to be packaged, such as tea leaves. The pair of measures 102B is intermittently reciprocated between a left end position shown in FIG. 11(*a*) and a right end position shown in FIG. 11(*b*) on a base 130 by a link mechanism 132 driven by a variable speed motor 131. When one of the first measure 102*i* and the second measure 102*ii* is located below a respective one of discharge holes 101*a* and 101*b* disposed in left and right end portions on the bottom of the hopper, the one of the first and second measures 102*i* and 102*ii* is filled with the object 85.

A set shutter 133 for opening and closing the bottom of the measure 102*i* or 102*ii* at predetermined timing is slidably fit into the base 130 of the object dispensing unit 100B, and a chute pipe 106 extends from a position directly below the set shutter 133 toward a horizontal bonding unit (not shown).

Figure 12:
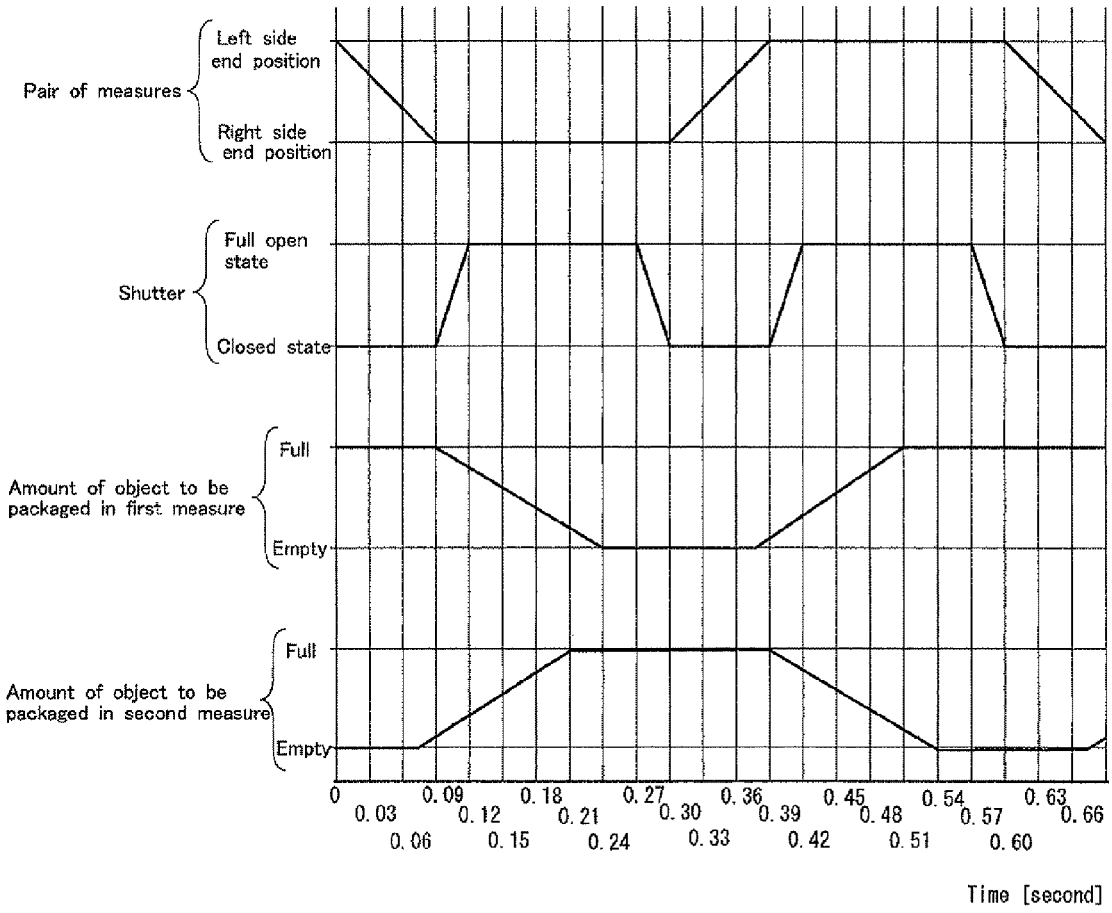
FIG. 12 is a timing chart for the object dispensing unit shown in FIG. 11.

FIG. 12 is a timing chart showing the positions of the first and second measures 102*i* and 102*ii*, the open-close state of the set shutter 133, and the packed states of the first and second measures 102*i* and 102*ii* with the object to be packaged.

When the pair of measures 102B is located at the left end position of its reciprocal movement, the first measure 102*i* is located below the left discharge hole 101*a* of the hopper and fully filled with the object 85 to be packaged. The pair of measures 102B starts moving rightward with the second measure 102*ii* located above the chute pipe 106 and being empty (0 seconds). When the first measure 102*i* is located above the set shutter 133 and the second measure 102*ii* is located below the right discharge hole 101*b* of the hopper, the movement of the pair of measures 102E is stopped, and the operation of filling the second measure 102*ii* with the object 85 is started. At the same time, the set shutter 133 starts opening (0.09 seconds), and the object 85 in the first measure 102*i* starts falling. After the set shutter 133 fully opens (0.12 seconds) and while the object 85 from the first measure 102*i* is falling, the second measure 102*ii* is fully filled with the object (0.21 seconds). After the first measure 102*i* is emptied (0.24 seconds), the set shutter 133 starts closing. When the set shutter 133 is fully closed, the pair of measures 102B starts moving leftward (0.3 seconds) and stops moving when the first measure 102*i* is located below the left discharge hole 101*a* of the hopper and the second measure 102*ii* is located above the set shutter 133. Then the operation of filling the first measure 102*i* with the object 85 is started. At the same time, the set shutter 133 starts opening (0.39 seconds), and the object 85 starts falling from the second measure 102*ii*. At this point, the object 85 that has fallen from the first measure 102*i* is still falling through the chute pipe 106 (see FIG. 10).

When the set shutter 133 is fully opened (0.42 seconds) and while the object 85 from the second measure 102*ii* is falling, the first measure 102*i* is fully filled with the object 85 (0.51 seconds). After the second measure 102*ii* is emptied (0.54 seconds), the set shutter 133 starts closing (0.57 seconds). After the set shutter 133 is fully closed, the pair of measures 102B again starts moving rightward. Then the above operation is repeated, and the object falls from the first and second measures 102*i* and 102*ii* into the chute pipe 106 in an alternating manner.

Also in this object dispensing unit 100B, before completion of the formation of horizontal bonding on a bag body packed with the object for a first bag that has fallen during the opening-closing operation of the set shutter 133, the object for a second bag that has been measured into a next measure starts falling. Therefore, high-speed packing operation can be achieved.

In the object dispensing unit 100B, the measures 102*i* and 102*ii* are in a stationary state when the object 85 starts falling from one of the measures 102*i* and 102*ii* and until the measure is emptied, so that the falling object does not have a horizontal velocity component and therefore falls straightly downward. Therefore, in the object dispensing unit 100B, the intermediate hopper 104 described above is not required.

The packing-packaging machine of the present invention can be implemented in other various modes. For example, a predetermined amount of the object for a single bag may be measured with a measure and may be measured with a computerized scale. A packet conveyer may be used to transfer the object for a single bag to the opening-closing position of the shutter.

The object is not limited to be dropped by its own weight into a bag body by the opening-closing operation of the shutter. The object may be allowed to fall with an initial velocity imparted thereto.

Two ultrasonic welding-cutting units provided such that their ultrasonic welding-cutting directions interest each other as viewed from above may be used as the horizontal bonding unit 76 to manufacture tetrahedral extraction bags. A welding-cutting unit having a single bonding direction that is not changed in an alternating manner may be used as the horizontal bonding unit 76 to manufacture flat extraction bags.

A so-called direct pressing type bonding head having an end width corresponding to the bonding width of an object to be bonded may be used as the bonding head of the horizontal bonding unit 76. In this case, before the falling path of the object 85 for a single bag is closed using the direct pressing type bonding head, the object for a next single bag is fed into the chute pipe 106.

No particular limitation is imposed on the bonding method. A thermal welding unit may be used, or an ultrasonic welding-cutting unit may be used.

When a pre-formed tubular body of a packaging sheet is used as the above-described tubular body of the packaging sheet, the packing-packaging machine is not required to include the vertical bonding unit.

The object to be packaged that is packed using the packing-packaging machine of the present invention is not limited to tea leaves for black teas, green teas, herbal teas, and other teas. Other examples of the object include dried small sardine, dried bonito, and other various powdery and granular material.

INDUSTRIAL APPLICABILITY

The packing-packaging machine of the present invention is useful for continuously manufacturing tea bags for black teas, green teas, herbal teas, and other teas and extraction bags containing dried products such as dried small sardine and dried bonito for preparing stock at high speed in a production line.

The invention claimed is:

1. A packing-packaging machine comprising:

a horizontal bonding unit for forming horizontal bonding at predetermined intervals on a tubular body formed from a packaging sheet to thereby form a bag body, the horizontal bonding being formed in a direction of a width of the tubular body; and an object dispensing unit for, during a repetition of formation of the horizontal bonding, dropping a predetermined amount of an object to be packaged, into the bag body to pack the bag body with the object, wherein the object dispensing unit comprises a plurality of measures for measuring and dispensing the predetermined amount of the object, the measures being disposed in a rotary table at regular intervals in a circumferential direction of the rotary table, and a first shutter forming a bottom of each of the measures, the first shutter opening and closing a falling path of the predetermined amount of the object into the bag body, the first shutter is opened and closed such that the predetermined amount of the object and another predetermined amount of the object fall with a spacing therebetween, and that before the horizontal bonding is completed for the bag body packed with the predetermined amount of the object which has been dropped during opening-closing operation of the first shutter, the other predetermined amount of the object for a next bag body starts falling, the object dispensing unit further comprises: an intermediate hopper provided at an upper end of the falling path; and a second shutter provided on a discharge hole of the intermediate hopper, the second shutter being configured to open and close by translational oscillation, and the first shutter of the measure and the second shutter of the intermediate hopper are respectively operated to do one cycle opening-closing operation for dropping the predetermined amount of the object.

2. The packing-packaging machine according to claim 1, wherein the first shutter is opened and closed such that a plurality of predetermined amounts of the object to be packaged are present in the falling path so as to be spaced apart from each other.

3. The packing-packaging machine according to claim 2, wherein the first shutter opens in a direction opposite to a running direction of the object when the shutter opens.

4. The packing-packaging machine according to claim 3, wherein the second shutter is opened with the object having no horizontal velocity component.

5. The packing-packaging machine according to claim 4, further comprising a chute pipe provided in the falling path, the chute pipe having an inner surface subjected to friction reducing treatment.

6. The packing-packaging machine according to claim 5, wherein the object to be packaged is a powdery or granular material.

7. A method for packing and packaging an object to be packaged, the method comprising:

forming horizontal bonding at predetermined intervals on a tubular body of a packaging sheet to thereby form a bag body, the horizontal bonding being formed in a direction of a width of the tubular body; and during a repetition of formation of the horizontal bonding, dropping a predetermined amount of the object into the bag body to pack the bag body with the object, wherein the predetermined amount of the object for a single bag is measured in each of a plurality of measures, which are formed in a rotary table at regular intervals in the circumferential direction thereof, a falling path of the predetermined amount of the object into the bag body is opened and closed using a first shutter provided on the bottom of each measure, and the first shutter is opened and closed such that the predetermined amount of the object and another predetermined amount of the object fall with a spacing therebetween, and that before the horizontal bonding is completed for the bag body packed with the predetermined amount of the object which has been dropped during opening-closing operation of the first shutter, the other predetermined amount of the object for a next bag body starts falling, an intermediate hopper is provided at an upper end of the falling path, and a second shutter is provided on a discharge hole of the intermediate hopper, so that vertical spreading of the object falling into the bag body is reduced, the second shutter being configured to open and close by translational oscillation, and the first shutter of the measure and the second shutter of the intermediate hopper are respectively operated to do one cycle opening-closing operation for dropping the predetermined amount of the object.

8. The method for packing and packaging according to claim 7, comprising opening and closing the first shutter such that a plurality of predetermined amounts of the object to be packaged are present in the falling path so as to be spaced apart from each other.

9. The method for packing and packaging according to claim 7, opening the first shutter in a direction opposite to a running direction of the object to be packaged when the first shutter opens.

10. The method for packing and packaging according to claim 7, comprising opening the second shutter with the object having no horizontal velocity component.

11. The method for packing and packaging according to claim 7, wherein a chute pipe is provided in the falling path, the chute pipe having an inner surface subjected to friction reducing treatment.

12. The method for packing and packaging according to claim 7, wherein the object to be packaged is a powdery or granular material.

13. A packing-packaging machine comprising:

a horizontal bonding unit for forming horizontal bonding at predetermined intervals on a tubular body formed from a packaging sheet to thereby form a bag body, the horizontal bonding being formed in a direction of a width of the tubular body; and an object dispensing unit for, during a repetition of formation of the horizontal bonding, dropping a predetermined amount of an object to be packaged from a rotary table into the bag body to pack the bag body with the object, wherein the object dispensing unit comprises a first shutter for opening and closing a falling path of the predetermined amount of the object into the bag body, and an intermediate hopper provided at an upper end of the falling path so as to eliminate the horizontal velocity component of the object dropped from the rotary table, the intermediate hopper having a second shutter on a discharge hole thereof, the first shutter is opened and closed such that the predetermined amount of the object and another predetermined amount of the object fall with a spacing therebetween, and that before the horizontal bonding is completed for the bag body packed with the predetermined amount of the object which has been dropped during opening-closing operation of the first shutter, the other predetermined amount of the object for a next bag body starts falling, and the first shutter of the measure and the second shutter of the intermediate hopper are respectively operated to do one cycle opening-closing operation for dropping the predetermined amount of the object for one bag body.

14. A method for packing and packaging an object to be packaged, the method comprising:

forming horizontal bonding at predetermined intervals on a tubular body of a packaging sheet to thereby form a bag body, the horizontal bonding being formed in a direction of a width of the tubular body; and during a repetition of formation of the horizontal bonding, dropping a predetermined amount of the object from a rotary table into the bag body to pack the bag body with the object, wherein an intermediate hopper is provided at an upper end of the falling path so as to eliminate the horizontal velocity component of the object dropped from the rotary table, and a second shutter is provided on a discharge hole of the intermediate hopper, so that vertical spreading of the object falling into the bag body is reduced;

a falling path of the predetermined amount of the object into the bag body is opened and closed using a first shutter;

the first shutter is opened and closed such that the predetermined amount of the object and another predetermined amount of the object fall with a spacing therebetween, and that before the horizontal bonding is completed for the bag body packed with the predetermined amount of the object which has been dropped during opening-closing operation of the first shutter, the other predetermined amount of the object for a next bag body starts falling; and the first shutter of the measure and the second shutter of the intermediate hopper are respectively operated to do one cycle opening-closing operation for dropping the predetermined amount of the object for one bag body.

* * * * *